US008807374B2

(12) United States Patent
Caunter et al.

(10) Patent No.: US 8,807,374 B2
(45) Date of Patent: Aug. 19, 2014

(54) BIMETALLIC CORROSION MITIGATION

(75) Inventors: Nicholas James Caunter, Oxfordshire (GB); Ian Maxwell, Reading Berkshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 247 days.

(21) Appl. No.: 13/128,542

(22) PCT Filed: Nov. 4, 2009

(86) PCT No.: PCT/EP2009/064634

§ 371 (c)(1), (2), (4) Date: May 10, 2011

(87) PCT Pub. No.: WO2010/052249

PCT Pub. Date: May 14, 2010

(65) Prior Publication Data

US 2011/0215099 A1 Sep. 8, 2011

(30) Foreign Application Priority Data

Nov. 10, 2008 (EP) ..... 08168718

(51) Int. Cl.

| | |
|---|---|
| ***B65D 17/40*** | (2006.01) |
| ***B65D 17/34*** | (2006.01) |
| ***B65D 41/32*** | (2006.01) |
| ***B65D 43/08*** | (2006.01) |

(52) U.S. Cl.

USPC ..... 220/359.4; 220/359.2; 220/270; 220/276; 413/12; 413/13; 413/14; 413/15; 413/16; 53/478; 53/485; 215/232

(58) Field of Classification Search

USPC ..... 220/359.2, 359.4, 270, 276, 265, 266, 220/359.1, 789, 791, 801; 413/12–16, 25; 53/478, 477, 476, 471, 485, 484; 215/232

See application file for complete search history.

(56) References Cited

U.S. PATENT DOCUMENTS

| | | | | |
|---|---|---|---|---|
| 3,861,976 | A * | 1/1975 | Gayner et al. | 156/257 |
| 4,526,287 | A * | 7/1985 | Miyamatsu et al. | 220/260 |
| 4,549,389 | A * | 10/1985 | Zichy | 53/471 |
| 2003/0062370 | A1 * | 4/2003 | Ball et al. | 220/359.2 |
| 2007/0131687 | A1 * | 6/2007 | Otto et al. | 220/212 |
| 2008/0290093 | A1 * | 11/2008 | Vadersen | 220/359.2 |

FOREIGN PATENT DOCUMENTS

| | | | |
|---|---|---|---|
| EP | 0408268 | A2 | 1/1991 |
| EP | 0438107 | A1 | 7/1991 |
| WO | WO 01/17852 | A1 | 3/2001 |
| WO | WO 2004/083066 | A | 9/2004 |
| WO | WO 2006/092364 | A2 | 9/2006 |
| WO | WO 2006/097005 | A | 9/2006 |

* cited by examiner

*Primary Examiner* — Fenn Mathew
*Assistant Examiner* — Jennifer Castriotta
(74) *Attorney, Agent, or Firm* — Baker & Hostetler LLP

(57) ABSTRACT

A metal closure is described, in the form of a foil lid (1) bonded to a metal annular component (such as a container body or separate intermediate ring). The foil lid (1) and annular component are made of dissimilar metals, with the closure adapted to prevent bimetallic corrosion at the interface between the dissimilar metals of the foil lid and the annular component. The closure is adapted such that the lid comprises a peripheral wall which is upstanding from the annular component such that a gap is maintained between the annular component and an exposed metal peripheral edge of the lid. Further aspects of the invention include: i. a method for making such a metal closure; and ii. an apparatus for making such a metal closure.

13 Claims, 6 Drawing Sheets

BIMETALLIC CORROSION MITIGATION

CROSS-REFERENCE TO RELATED APPLICATIONS

This application is the National Stage of International Application No. PCT/EP2009/064634, filed Nov. 4, 2009, which claims the benefit of EP Application No. 08168718.8, filed Nov. 10, 2008, the disclosures of which are incorporated herein by reference in their entirety.

TECHNICAL FIELD

This invention relates to a metal closure in the form of a foil lid bonded to a metal annular component (such as a container body or separate ring), the foil lid and annular component made of dissimilar metals, with the closure adapted to prevent bimetallic corrosion at the interface between the dissimilar metals of the foil lidding and the annular component. Further aspects of the invention include:

a method for making such a metal closure; and an apparatus for making such a metal closure.

BACKGROUND ART

In the field of metal packaging for food/beverages, it is well known to seal the access opening of a container body using a foil lid. By "foil" is meant a flexible lidding material including a base layer of metal. The metal base layer provides strength to the lid, forms a barrier to mitigate loss of moisture and flavours from a filled container, and prevents contamination. The foil lid may be bonded to an intermediate metal ring, the ring then seamed to a container body. Alternatively, the foil lid may be bonded directly to the container body as described in WO 2006/092364 A (CROWN PACKAGING TECHNOLOGY, INC) Aug. 9, 2006. As explained below, it is commonplace for dissimilar metals to be used for the foil lid and the ring/container body.

Aluminium is particularly favoured as a material for the base layer of the foil lid because it has a high strength to weight ratio (relative to, say, steel) and can easily be coated with other materials to provide additional properties; for example, with heat seal lacquers to provide heat sealability. Steel is particularly favoured for the ring/container body due to its high strength and relatively low cost. The steel is typically supplied to can makers either as tin-plate (which is steel with a very thin layer of tin electro-deposited onto both sides), or as tin-free steel. For many food and beverage cans it is necessary to coat the metal of the ring/container body with one or more polymer coatings to prevent chemical interactions (e.g. corrosion) occurring between the metal of the ring/container body and the product or external environment. Examples of such polymer coatings include epoxy-based lacquers and polypropylene-based lacquers. In the field of food/beverage packaging, it is essential to reduce/eliminate any corrosion on grounds of hygiene and aesthetics.

The coatings provided on the dissimilar metals of the foil lid and the ring/container body are also intended to prevent electrically conductive contact occurring between these dissimilar metals. However, as explained below, these coatings are not always effective at preventing conductive contact between the dissimilar metals, with the risk of unsightly and unhygienic "bimetallic corrosion" at locations where conductive contact occurs.

Explained simply, "bimetallic corrosion" is the corrosion that occurs when dissimilar metals come into conductive contact in the presence of an electrolyte. It is also known as galvanic corrosion. In bimetallic corrosion, the corrosion of a reactive metal (the anode) occurs due to positive electric current flowing from the anode to the less reactive (more noble) metal (the cathode) through the electrolyte. This process is similar to the conventional corrosion of a single uncoupled metal, but generally proceeds at a higher rate depending on the difference in the electrochemical reactivity of the anode and cathode metals. In the context of the present invention, "dissimilar metals" therefore mean metals having different electrochemical reactivities such that when they are put into conductive contact in the presence of an electrolyte, bimetallic corrosion can occur.

By way of example, considering the case of an aluminium-based foil lid bonded to a steel/tin-plate ring/container body: aluminium is more anodic than both conventional carbon steel and tin; consequently, any conductive contact between the aluminium of the foil lid and the dissimilar metal of the ring/container body risks bimetallic corrosion of the aluminium of the lid at those points of contact.

Typically, the first stage in making a foil lid is to cut a blank out of a sheet of pre-coated foil lidding material. Regardless of any coating that may have been pre-applied to the sheet of lidding material, the action of cutting results in a surface of the metal of the foil lid (e.g. aluminium) being exposed at the peripheral cut edge of the lid. During the process of locating the lid against the ring/container body and subsequent bonding, it has been found that any relative movement between the lid and the ring/container body can result in the exposed peripheral metal edge of the foil cutting through any coatings on the ring/container body and thereby establishing direct metal:metal contact. This risk is exacerbated if the ring/container body is used as a forming die to shape the periphery of the lid—as illustrated in FIGS. 9-11 of WO 2006/092364A. In WO 2006/092364A, an inclined region is applied to a planar foil lid blank by drawing the lid blank against a correspondingly inclined surface of a container body, bonding between the container body and foil lid then occurring between the respective inclined regions of the lid and container body. The action of drawing the lid against the container body can easily result in any coating on either the container body or the foil lid being scratched or damaged, thereby exposing the underlying metal of the container body and presenting an additional route by which conductive metal to metal contact will occur. Additionally, subsequent handling and transportation of filled containers is also highly likely to result in scratching and other damage to any coating provided on the ring/container body, thereby exposing the bare metal of the ring/container body. Where these scratches—regardless of how they occurred—are adjacent the exposed peripheral metal edge of the lid, electrolyte in the form of water or other chemicals can easily establish a conductive path between the dissimilar metals of the lid and the ring/container body, and bimetallic corrosion can quickly occur.

In technical fields outside of metal packaging, known ways of mitigating the risk of bimetallic corrosion include:

Galvanizing the least noble metal with a sacrificial metal coating, e.g. as used for protecting car body panels. Whilst technically feasible, it is undesirable for packaging because the galvanising process would increase manufacturing costs.

The present invention therefore has the objects of:

Providing an improved metal closure having a foil lid sealed to an annular component—the lid and annular component made of dissimilar metals—with a cheap and effective means of reducing the risk of galvanic (bimetallic) corrosion between the dissimilar metals of the lid and the annular component.

Providing a method and apparatus for making such a closure.

DISCLOSURE OF INVENTION

Accordingly, a first aspect of the present invention provides a closure for a container, the closure comprising a flexible foil lid bonded to a sealing panel provided on an annular component, the foil lid and the annular component being made of dissimilar metals, at least one of the opposing surfaces of the lid and the annular component comprising a non-metal coating, a surface of the metal of the foil lid being exposed at the peripheral edge of the lid, characterised in that the lid comprises a peripheral wall which is upstanding from the annular component such that a gap is maintained between the annular component and the exposed metal peripheral edge of the lid.

Providing the foil lid with a peripheral wall upstanding from the annular component has the advantage of establishing some clear distance between the exposed metal peripheral edge of the lid and any exposed metal of the annular component. This feature reduces/avoids any conductive path being established between the dissimilar metals of the lid and annular component (and consequent bimetallic corrosion) in the event of any damage to the non-metal coating(s).

The metal of the foil lid provides a gas-tight and light-tight barrier, and thereby helps to maintain product freshness in containers incorporating the closure of the present invention.

It is likely that non-metal coating(s) will be provided on the opposing surfaces of both the lid and the annular component to avoid exposure of bare metal to the atmosphere. It is preferred that the non-metal coating(s) are conventional polymer coatings of the type commonly used in can manufacture. The present invention is particularly beneficial for peelable closures where the foil lid is peelably attached to the annular component. Peelability may be provided by selection of the coatings used on the opposing surfaces of the lid and the annular component. By way of example, the metal of the annular component may be coated with a heat sealable lacquer made up of polypropylene dispersed within an epoxy-phenolic base. In turn, the opposing surface of the metal of the foil lid may have a coating of polypropylene. Application of pressure and heat to the lid and annular component at the location of the sealing panel would then result in a heat seal bond being formed between the heat sealable lacquer on the annular component and the polypropylene on the lid. This bond would be peelable.

The annular component may be an integral part of a container body (as shown in WO 2006/092364A in which a foil lid is directly sealed to the sidewall of a container body). Alternatively, the annular component may be a separate entity such as an intermediate metal ring separately attachable to a container body (for example, by double seaming).

It has been found highly desirable for the peripheral wall to be located below the uppermost plane of the annular component. This feature has the effect of shielding the upstanding peripheral wall of the foil lid from impact damage.

It is preferable to minimise the height of the peripheral wall to reduce the risk of the wall becoming snagged on any objects during subsequent transportation and/or other handling of the closure. It has been found beneficial to form the lid with the peripheral wall having a height less than 1 mm. "Height" is defined as the linear distance from the base of the peripheral wall to the peripheral edge of the lid. Minimising the wall height has been found to avoid wrinkling of the peripheral wall, whilst also maintaining distance between the exposed peripheral metal edge of the lid and the annular component, thereby reducing the risk of a conductive path being established between the dissimilar metals of the lid and annular component.

Where a first container is provided with the closure of the present invention, preferably the peripheral wall of the foil lid and the base of the container are cooperatively profiled such that the base of a second identical container is locatable against the closure of the first container radially inward of the foil lid's upstanding peripheral wall. This ensures that during stacking of the containers, the upstanding peripheral wall of the foil lid is not damaged.

The present invention may conveniently be applied to annular components having either non-inclined or inclined sealing panels. By "non-inclined" is meant where the sealing panel of the annular component defines a plane that is generally parallel to the plane defined by the closure. However, the present invention has been found to be of particular benefit where the sealing panel of the annular component is inclined relative to the closure's longitudinal axis.

The sealing panel is preferably upwardly and outwardly inclined relative to the longitudinal axis of the closure. This feature has the advantage of providing the annular component with a firm, recessed surface for securely stacking one container upon another, without risk of rupturing the relatively thin material of the foil lid. Preferably, the sealing panel is upwardly and outwardly inclined at an angle $\alpha$ of from 20° to 60° to the longitudinal axis of the closure. Most preferably, where a first container is provided with the closure of the present invention, the recessed surface described above is combined with the peripheral wall of the foil lid and the base of the first container being cooperatively profiled such that the base of a second identical container is locatable against the closure of the first container radially inward of the foil lid's upstanding peripheral wall. In this case, the recessed surface defined by the upwardly and outwardly inclined sealing panel of the annular component provides stackability and helps to "centre" the base of the second container relative to the first container during stacking, thereby helping to avoid damage to the peripheral wall.

Additional aspects of the present invention also provide a method and an apparatus suitable for manufacturing the closure described above. These are outlined below.

Accordingly, a second aspect of the invention provides a method for making a closure, the closure having a foil lid bonded to an annular component, the foil lid and annular component made of dissimilar metals, with at least one of the opposing surfaces of the lid and the annular component comprising a non-metal coating, the method comprising the following steps:

i. taking a foil lid blank, with a surface of the metal of the blank being exposed at the peripheral edge of the blank;

ii. placing the blank between a preforming die and a punch;

iii. urging either or both of the preforming die and the punch towards each other such that the blank is preformed between corresponding opposing surfaces of the punch and the die to provide a preformed lid having a peripheral wall;

iv. either or both of the preformed lid and the annular component moved relative to each other to thereby locate the preformed lid against a sealing panel of the annular component, the peripheral wall upstanding from the annular component throughout this step such that a gap is provided; between the annular component and the exposed metal peripheral edge of the lid; and v. bonding the preformed lid radially inward of the peripheral wall to the sealing panel of the annular component to thereby form the closure, the peripheral wall remaining upstanding from the annular component throughout this step such that a gap is maintained between the annular component and the exposed metal peripheral edge of the lid.

The advantage of ensuring during step iv that the peripheral wall is upstanding away from the annular component, is that there is a dramatically reduced risk of any relative movement between the annular component and the foil lid resulting in the peripheral edge of the lid cutting through any non-metal coating(s) provided on the surface of the annular component. Thereby, the risk of conductive contact between the dissimilar metals of the lid and the annular component (and consequent bimetallic corrosion) is also reduced. This advantage is achieved at minimal cost, with minimal changes required to existing manufacturing tooling. A container having this closure would then typically be supplied to customers with the peripheral wall remaining upstanding away from the annular component.

As stated above, the annular component may be part of a container body itself or a separate intermediate metal ring.

Conveniently, in step ii the lid blank is removably retained on a surface of the punch. The removable retention is preferably achieved by means of vacuum pressure; for example, holes may be provided on the surface of the punch through which vacuum pressure is applied to suck the lid onto the surface of the punch. Alternatively, the lid is simply located on an end face of the preforming die during step ii prior to the commencement of preforming step iii.

It is envisaged that between steps iii and iv, the preformed lid will be separated from the punch and moved to an intermediate holder for commencement of step iv. However, in an alternative method, on completion of step iii and during step iv the preformed lid is removably retained on the punch, with the annular component and combination of the punch and preformed lid moved relative to each other to thereby locate the preformed lid against the sealing panel, the peripheral wall upstanding from the annular component throughout this step.

In certain cases, it will be desired to seal the foil lid to an inclined sealing panel on the annular component (as shown in WO 2006/092364A). One preferred way of achieving this is—during step iii—for either or both of the preforming die and the punch to be urged towards each other to preform the blank between corresponding opposing surfaces of the die and the punch to thereby form a preformed lid having both the peripheral wall and an inclined annular region located radially inwardly of the peripheral wall; with step iv modified such that either or both of the preformed lid and the annular component are moved relative to each other to locate the inclined annular region of the lid against the sealing panel of the annular component, the sealing panel being correspondingly inclined.

In a third aspect of the present invention there is provided an apparatus for making a closure having a preformed foil lid bonded to an annular component, the apparatus comprising a preforming die and a punch, the punch and the die having cooperable opposing surfaces, the apparatus further comprising means for urging either or both of the punch and the die towards each other to preform the foil lid blank between the opposing surfaces to thereby form a preformed lid having a peripheral wall, the apparatus adapted to move either or both of the preformed lid and the annular component relative to each other to locate the lid against a sealing panel of the annular component, whilst ensuring that the peripheral wall remains upstanding from the annular component such that a gap is provided between the annular component and the exposed metal peripheral edge of the lid, the apparatus further including means for bonding the preformed lid radially inward of the peripheral wall to the sealing panel of the annular component to thereby form the closure, whilst ensuring that the peripheral wall remains upstanding from the annular component such that a gap is maintained between the annular component and the exposed metal peripheral edge of the lid.

In an additional embodiment, the apparatus further comprises means for locating the foil lid blank at a location between the punch and the die.

Preferably, the punch comprises means for retaining the preformed lid on the punch. As described above, the retention may be by means of vacuum pressure applied via holes on the surface of the punch.

It is to be understood that one or more of the features detailed above may be interchanged between the claimed method and apparatus.

BRIEF DESCRIPTION OF FIGURES IN THE DRAWINGS

An embodiment of the invention is described below, with reference to the following drawings.

MODE(S) FOR CARRYING OUT THE INVENTION

Figure 1:
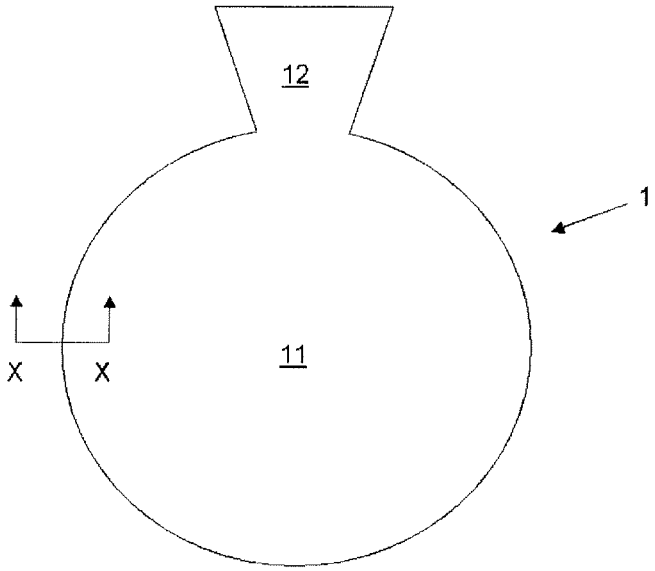
FIG. 1 is a plan view of a foil lid blank (i.e. before any preforming operation).
Figure 2:
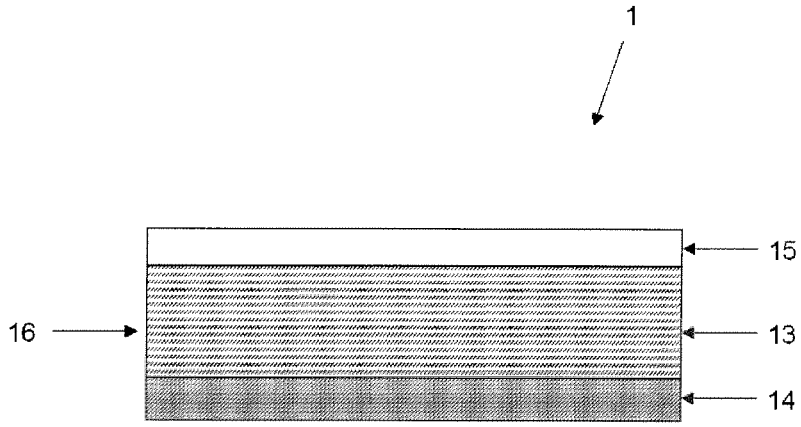
FIG. 2 is a cross-section view of the blank of FIG. 1 through section X-X.

One or more lid blanks 1 are first cut (or stamped) out from a sheet (not shown) of pre-coated foil lidding material—see FIG. 1. Each blank 1 is generally circular in plan, having both a central cover portion 11 and an integral tab 12 (see FIG. 1). As shown in the cross-section view of FIG. 2, the blank 1 has a metal substrate 13 (formed in this case of aluminium) of 70 microns thickness. The lower surface of the aluminium substrate 13 includes a polypropylene-based coating 14, with the upper surface of the metal substrate including a coating of polyethylene terephthalate (PET) 15. As can clearly be seen in FIG. 2, a surface 16 of the metal substrate 13 is exposed along the peripheral cut edge of the blank 1.

Figure 3:
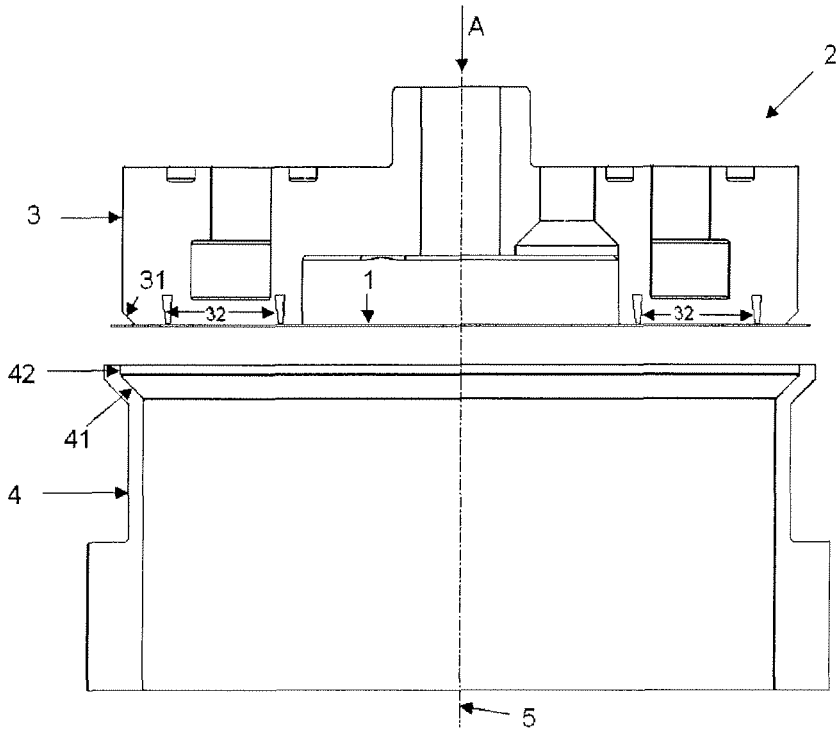
FIG. 3 is a schematic elevation view of an apparatus when configured to preform the blank of FIGS. 1 & 2.

One example of an apparatus and method for manufacturing the closure of the present invention is now described below:

FIG. 3 shows the initial configuration of an apparatus 2. The apparatus 2 has a punch 3. The lower surface of the punch 3 is generally planar, but with an inclined region 31 provided at its periphery. Situated beneath the punch 3 is a cylindrical preforming die 4. The inner surface of the preforming die 4 has an inclined region 41 with a geometric profile corresponding to that of the inclined region 31 of the punch 3. A cylindrical wall 42 extends upwardly from the radial outer edge of the inclined region 41 of the die 4, being of a diameter corresponding to that of the punch 3. Both the punch 3 and the preforming die 4 are located on a common longitudinal axis 5.

The lid blank 1 described above is removably retained against the punch 3 by vacuum pressure applied through narrow holes 32 provided on the central region of the punch 3. As indicated by arrow "A" on FIG. 3, the punch 3 and retained lid blank 1 are together driven down along the axis 5 to preform the lid blank 1 between the corresponding surfaces of the punch 3 and preforming die 4. Hydraulic or similar conventional means are used to drive down the punch 3 into mating contact with the preforming die 4. In alternative embodiments:

i) the preforming die 4 is driven towards the punch 3, or ii) both the punch 3 and the preforming die 4 are both moveable towards each other.

Figure 4:
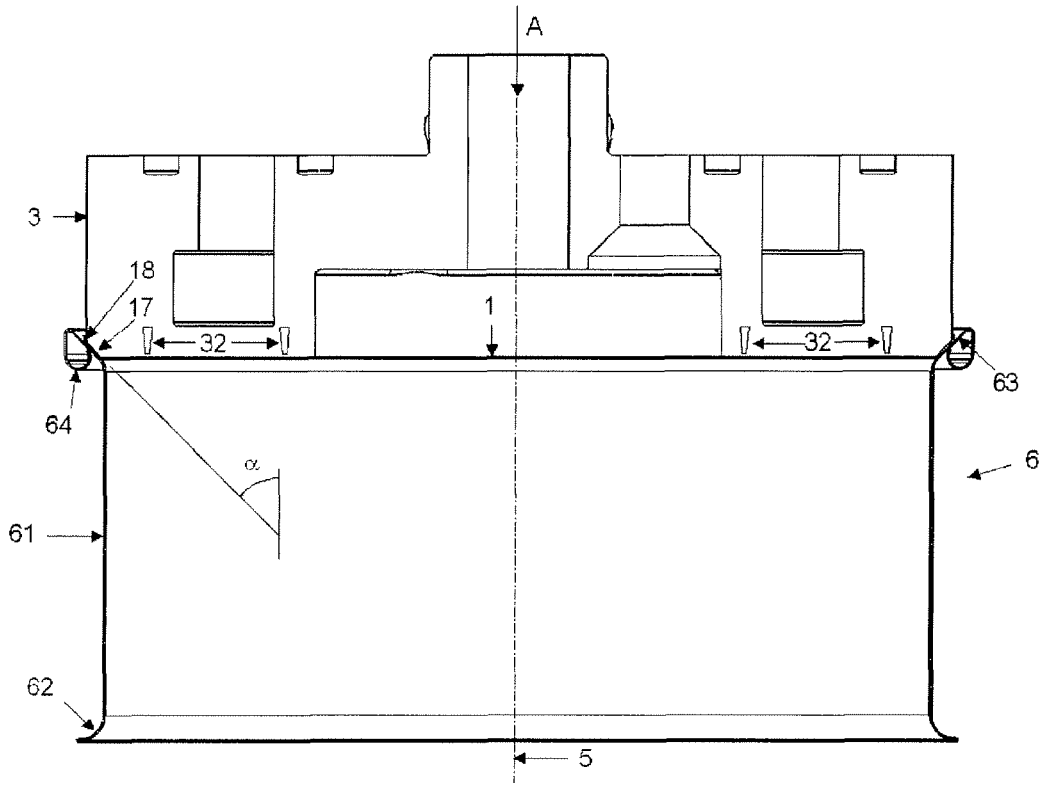
FIG. 4 is a schematic elevation view of the apparatus of FIG. 3 when configured to locate the preformed lid against a sealing panel on a container body.

Pressing the punch 3 and the die 4 together (with the lid blank 1 sandwiched in between) preforms the lid blank into a lid having both an inclined annular region 17 and a peripheral wall 18 (see FIG. 4). The peripheral wall 18 has a uniform height "h" of approximately 0.5 mm (see FIG. 6).

On completion of the preforming step, the punch 3 and preformed lid 1 are moved together in combination to locate above and coaxial with a steel container body 6 (see FIG. 4). The container body 6 has a cylindrical sidewall 61 defining lower and upper access openings. At the lower access opening the sidewall 61 is flared outwardly 62. At the upper access opening the sidewall 61 is upwardly and outwardly inclined (relative to axis 5) at an angle "α" of approximately 45° to define a recessed annular sealing panel 63. As referred to in the general description of the invention, this recessed annular sealing panel 63 helps to provide stackability of one container upon another. Radially outward of the sealing panel 63 the sidewall 61 terminates in a curl 64 to provide the container body 6 with rigidity. The inclination angle "α" of the annular sealing panel 63 corresponds to that of the inclined annular region 17 of the preformed lid 1. Although not shown on the figures, the steel of the container body 6 is coated with a heat sealable lacquer (for example, a lacquer made of polypropylene dispersed within an epoxy-phenolic base). As indicated in FIG. 4, the punch 3 and preformed lid 1 are moved together along axis 5 (see arrow "A") to locate the inclined annular region 17 of the lid against the annular sealing panel 63 of the container body 6. FIG. 4 shows the final position of the punch 3 and preformed lid 1 after location against the container body 6. The peripheral wall 18 of the preformed lid 1 is upstanding from the annular sealing panel 63 during this locating step (see FIG. 5), thereby maintaining clear distance between the exposed peripheral aluminium edge 16 of the lid and the steel container body 6.

Figure 5:
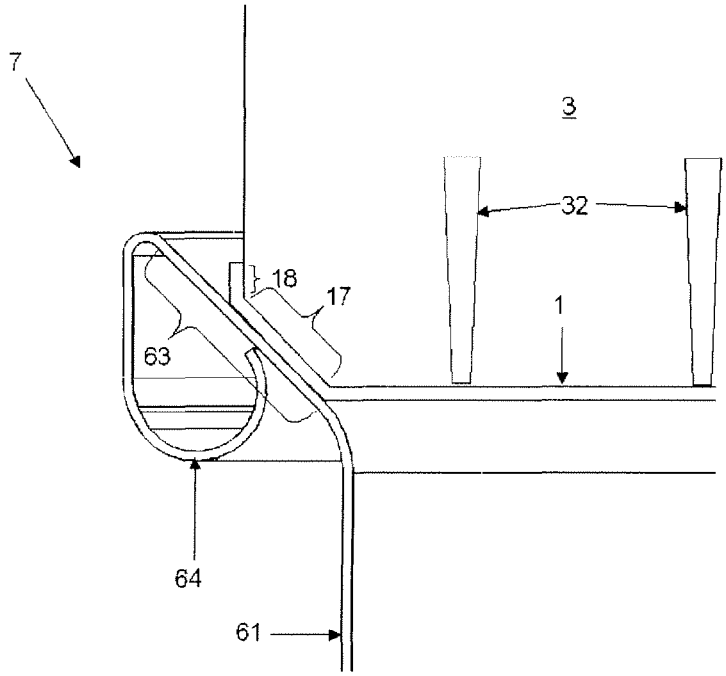
FIG. 5 is a detail view corresponding to FIG. 4.

Once located in position as shown on FIGS. 4 & 5, the preformed lid 1 is directly bonded to the container body 6 (via annular sealing panel 63) by heat sealing. A hermetic heat seal bond is thereby established between the polypropylene-based coating of the preformed lid 1 and the heat sealable lacquer of the container body 6. Although not shown on the figures, the heat sealing is preferably activated by induction heating. In this way, the punch 3 is able to apply both heat and pressure to maximise the strength of the resulting bond between the preformed lid 1 and the container body 6.

Figure 6:
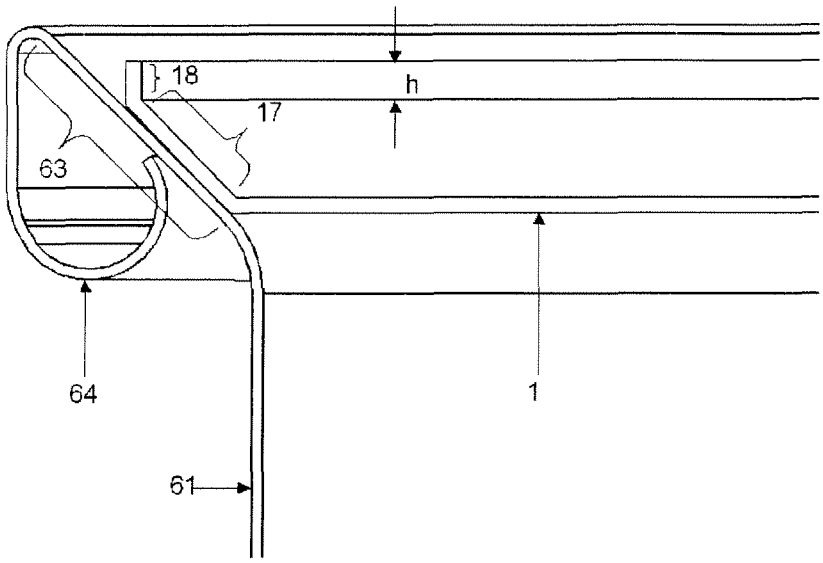
FIG. 6 is similar to FIG. 5, but showing the preformed lid after it has been bonded to the container body (and after retraction of the punch).

On completion of the heat sealing (bonding) step, the punch 3 is retracted from the container body 6—a detail view of the resulting container 7 is shown in FIG. 6. In the embodiment shown, on completion of the bonding step the peripheral wall 18 of the preformed lid 1 remains upstanding from and divergent away from the surface of the container body 6—thereby maintaining clear distance and hindering any conductive contact between the dissimilar metals of the lid 1 and the container body 6. However, in an alternative embodiment not illustrated in the figures, the apparatus further includes a reforming tool which acts against the peripheral wall 18 of the lid 1 to reform the wall flush against the surface of the container body. As can be seen from FIG. 6, the peripheral wall 18 remains located below the uppermost plane of the container body 6.

Figure 7:
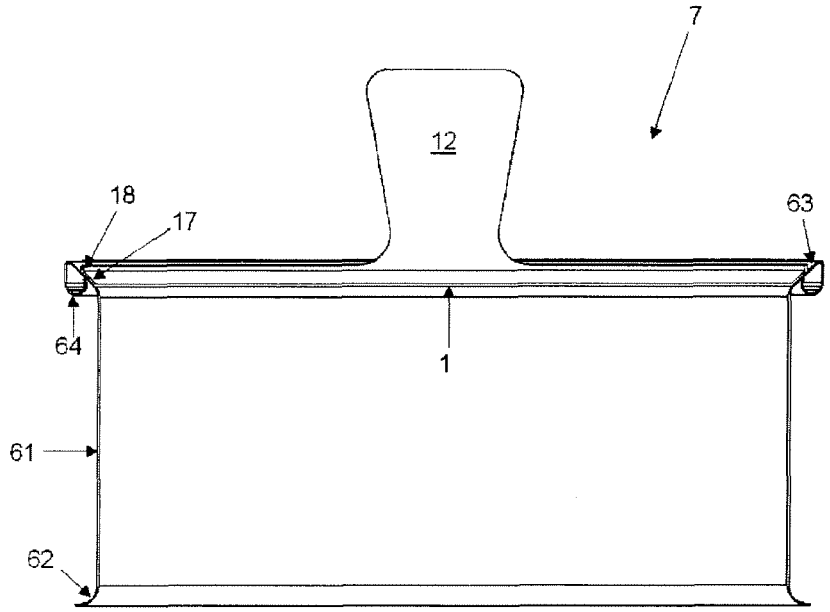
FIG. 7 is a section view through the container body and lid after bonding of the lid.
Figure 8:
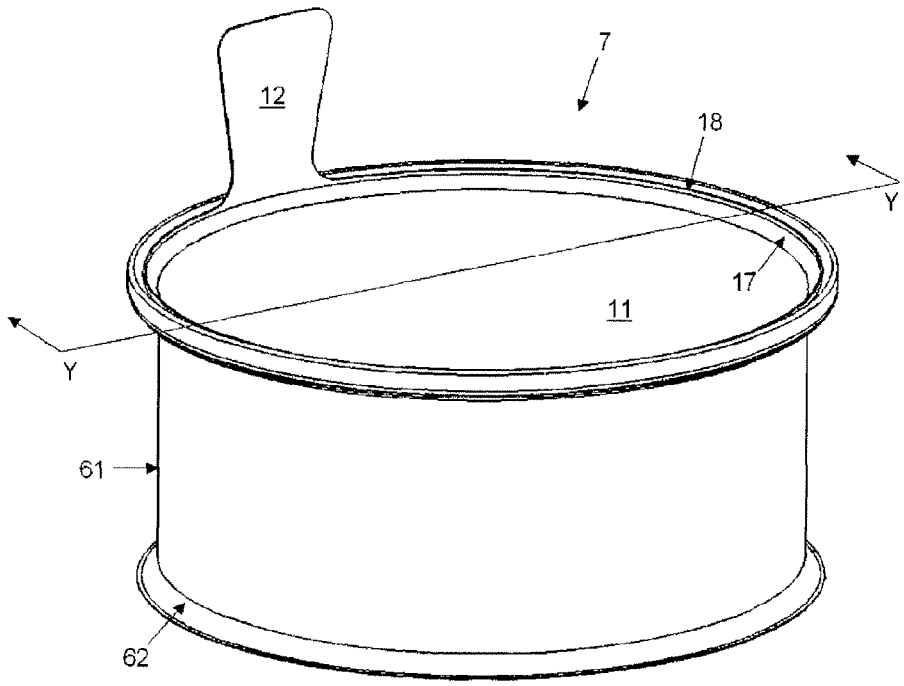
FIG. 8 is a perspective view of the container body and lid after bonding of the lid.
Figure 9:
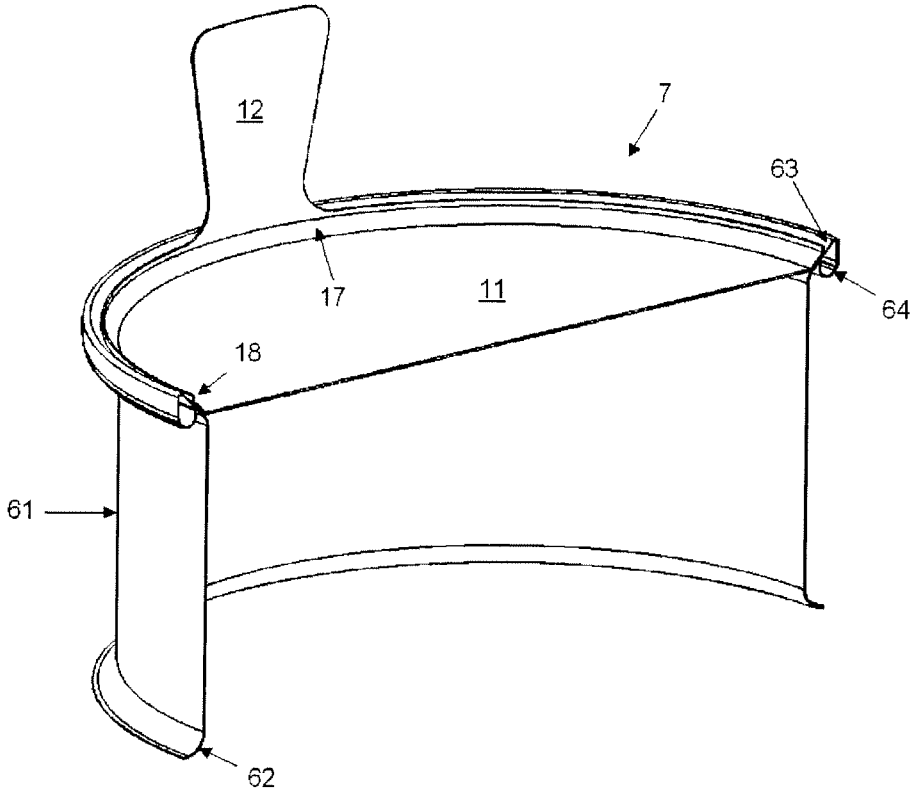
FIG. 9 is a perspective view along section Y-Y of FIG. 8.

FIGS. 7-9 each show alternative views of the container 7 that results from using the apparatus and method described above. Subsequently, the container 7 would typically be inverted and filled with product via the lower access opening, with a conventional can end fixed to seal the lower access opening of the container 7.

Although the invention is shown in use on foil lids/container bodies of generally circular cross-section, it is equally applicable to any other cross-section profile.

The invention claimed is:

1. A closure for a container, the closure comprising:

a flexible foil lid for bonding to a sealing panel provided on an annular component, the foil lid and the annular component being made of dissimilar metals, a surface of the lid comprising a non-metal coating, a surface of the metal of the foil lid being exposed at the peripheral edge of the lid, the lid comprising a circumferential peripheral wall which extends about a majority of the peripheral edge of the lid and which is upstanding from the annular component such that a gap is maintained between the annular component and the exposed metal peripheral edge of the lid and the exposed metal peripheral edge of the lid is removed from the annular component so as to minimize bimetallic corrosion between the exposed metal peripheral edge of the lid and the annular component.

2. A closure as claimed in claim 1, wherein the peripheral wall is below the uppermost plane of the annular component.

3. A closure as claimed in claim 1, wherein the peripheral wall has a height of less than 1 mm.

4. A closure as claimed in claim 1, wherein the annular component is an integral part of the sidewall of a container body.

5. A closure as claimed in claim 1, wherein the sealing panel is upwardly and outwardly inclined relative to the longitudinal axis of the closure to define a recessed surface.

6. A closure as claimed in claim 5, wherein the sealing panel is upwardly and outwardly inclined at an angle α of from 20° to 60° to the longitudinal axis of the closure.

7. A container and closure combination; the container including an annular component having a sealing panel formed thereon, the container formed of a material comprising a metal;

the closure including a flexible foil lid bonded to the sealing panel provided on the annular component, the foil lid and the annular component being made of dissimilar metals, at least one of the opposing surfaces the lid and the annular component comprising a non-metal coating, a surface of the metal of the foil lid being exposed at the peripheral edge of the lid, the lid further comprising a circumferential peripheral wall which extends about a majority of the peripheral edge of the lid and which is upstanding from the annular component such that a gap is maintained between the annular component and the exposed metal peripheral edge of the lid and the exposed metal peripheral edge of the lid is removed from the annular component so as to minimize bimetallic corrosion between the exposed metal peripheral edge of the lid and the annular component.

8. A combination as claimed in claim 7, wherein the peripheral wall is below the uppermost plane of the annular component.

9. A combination as claimed in claim 7, wherein the peripheral wall has a height of less than 1 mm.

10. A combination as claimed in claim 7, wherein the annular component is an integral part of the sidewall of a container body.

11. A combination as claimed in claim 7, wherein the sealing panel is upwardly and outwardly inclined relative to the longitudinal axis of the closure to define a recessed surface.

12. A combination as claimed in claim 7, wherein the sealing panel is upwardly and outwardly inclined at an angle $\alpha$ of from 20° to 60° to the longitudinal axis of the closure.

13. A combination as claimed in claim 7, wherein the peripheral wall of the foil lid and the base of the container are cooperatively profiled such that the base of a second identical container is locatable against the closure of the first container radially inward of the foil lid's upstanding peripheral wall.

* * * * *